US005642835A

United States Patent [19]

Young et al.

[11] Patent Number: 5,642,835

[45] Date of Patent: Jul. 1, 1997

[54] SHEET PRODUCTS FOR USE IN A POP-UP DISPENSER AND METHOD FOR FORMING

[75] Inventors: Terrill A. Young, Cincinnati; Charles J. Berg, Jr., Wyoming, both of Ohio

[73] Assignee: The Procter & Gamble Company, Cincinnati, Ohio

[21] Appl. No.: 572,805

[22] Filed: Dec. 15, 1995

[51] Int. Cl.[6] ..... B65G 59/00

[52] U.S. Cl. ..... 221/1; 221/48; 206/494

[58] Field of Search ..... 221/48, 47, 50, 221/55, 63, 51, 38, 1; 206/494, 449

[56] References Cited

U.S. PATENT DOCUMENTS

| | | | |
|---|---|---|---|
| 1,385,569 | 7/1921 | Mayer et al. | 270/21 |
| 1,979,876 | 11/1934 | Fischer | 206/494 |
| 2,211,494 | 8/1940 | Christman | 206/494 |
| 2,353,183 | 7/1944 | Niederauer | 217/3 |
| 2,477,223 | 7/1949 | West | 206/494 |
| 3,066,932 | 12/1962 | Greiner et al. | 270/40 |
| 3,172,564 | 3/1965 | Enloe et al. | 221/48 |
| 3,248,102 | 4/1966 | Couzense et al. | 221/48 |
| 3,282,525 | 11/1966 | Rehr | 242/56.2 |
| 3,307,844 | 3/1967 | Stults | 270/40 |
| 3,462,043 | 8/1969 | Frick | 221/48 |
| 3,486,957 | 12/1969 | Fish et al. | 156/88 |
| 3,542,356 | 11/1970 | Murphy et al. | 270/40 |
| 3,848,501 | 11/1974 | Kuts | 83/471.3 |
| 3,862,610 | 1/1975 | Brocklehurst | 112/121.11 |
| 3,965,785 | 6/1976 | Johns | 83/316 |
| 4,002,092 | 1/1977 | Smith et al. | 83/55 |
| 4,010,664 | 3/1977 | Marshall | 83/277 |
| 4,055,697 | 10/1977 | Schmanski | 428/113 |
| 4,106,166 | 8/1978 | Henning | 28/103 |
| 4,131,271 | 12/1978 | Slawny | 270/40 |
| 4,266,112 | 5/1981 | Niedermeyer | 219/121 LN |
| 4,300,891 | 11/1981 | Bemiss | 493/8 |
| 4,340,441 | 7/1982 | Thwaites et al. | 156/512 |
| 4,416,376 | 11/1983 | Scheffers et al. | 206/554 |
| 4,425,109 | 1/1984 | Konsti et al. | 493/410 |
| 4,480,772 | 11/1984 | Gerndt | 223/1 |
| 4,574,670 | 3/1986 | Johnson | 83/409 |
| 4,609,366 | 9/1986 | Ley et al. | 493/22 |
| 4,630,514 | 12/1986 | Ohmori et al. | 83/342 |
| 4,664,006 | 5/1987 | Mitchell | 83/341 |
| 4,748,909 | 6/1988 | Theilacker | 101/226 |
| 4,922,775 | 5/1990 | Winter | 83/333 |
| 5,328,053 | 7/1994 | Cook et al. | 221/63 |
| 5,332,118 | 7/1994 | Muckenfuhs | 221/48 |

FOREIGN PATENT DOCUMENTS 1454971 10/1964 Germany .

OTHER PUBLICATIONS

The mechanics of web spreading: Part 1 *Web Spreading*, vol. 76, No. 10 Tappi Journal, pp. 63–70.

*Primary Examiner*—Kenneth Noland
*Attorney, Agent, or Firm*—Dinsmore & Shohl LLP

[57] ABSTRACT

An improved method is disclosed for forming a strata of overlapping sheets suitable for use in a pop-up dispensing system. The sheets are cut from ribbons having at least one side edge which has a knee-like protrusion, with the opposing side edge being either, substantially parallel to the longitudinal axis of the ribbon, or having one or more knee-like protrusions formed on the opposing edge. The ribbons are then phased so that the knee-like protrusion on one edge aligns with either the essentially parallel edge of an adjoining ribbon or a knee-like protrusion on the side edge of the adjoining ribbon. Phasing can be accomplished by either, aligning knee-like protrusions on the side edges of adjoining ribbons, or reversing the orientation of the side edges of alternating ribbons. After phasing, the ribbons are overlapped creating a series of predetermined, areas of greatest overlap adjoining areas of least overlap such that successive ribbons are bonded only by the interfacial interaction between ribbons. By overlapping multiple ribbons in this manner a strata is formed which is then folded to interleave the ribbons. A resulting stack of interleaved ribbons is cut to form blocks of individual interleaved sheets. The process can be accomplished manually or in a continuous production process.

20 Claims, 3 Drawing Sheets

SHEET PRODUCTS FOR USE IN A POP-UP DISPENSER AND METHOD FOR FORMING

FIELD OF INVENTION

This invention relates to an improved strata arrangement of sheets for use in a pop-up dispensing system, and method for forming sheets from ribbons which are oriented into a substantially continuous strata.

BACKGROUND OF THE INVENTION

Disposable towelettes and similar sheet products, sometimes generally referred to as "wipes", which are dispensed from a container, or from individually wrapped packages, have become a fixture in today's society. For example, wipes are used for hygienic purposes as well as routine, nonhygienic cleaning and wiping. The size, shape, thickness, durability, moisture content, and lotion content of the wipe can all be adjusted for a variety of uses, and the versatility of such products has contributed to the popularity of wipes in general.

Due to the variety of uses for sheet products such as wipes, they have taken on numerous physical forms, and their dispensing mechanisms have likewise been varied. There are a variety of dispensing mechanisms that involve containers and some that do not. For example, rolls of dry paper towels and toilet paper do not require containers because of their low moisture content. "Dry" sheet products often include lotions or other additives and are not necessarily moisture free. Rather "dry" sheet products are sheets with low moisture content that are generally dry to the touch of an average consumer. Paper towels and toilet paper are generally in the form of rolled continuous sheets with perforations defining the individual leaves. A consumer unrolls the number of leaves that he or she needs and tears them from the roll along the perforations between leaves.

Often sheets are premoistened with lotions, cleansing agents or the like. A popular method for dispensing moistened sheets, "wet wipes", is a combination of the perforated roll and the container dispenser. Ribbons of sheets are often perforated, rolled, placed in a rigid container and then lotions and/or cleansing agents are added. For dispensing, individual wet wipes are generally pulled through a small aperture in the container and then tom along the perforations to remove the sheet. Problems with such arrangements can arise as the dispensing aperture is typically small to minimize evaporative loss of moisturizing agent from the products closest to the top. The smaller sized aperture, in turn, requires an increase in force to withdraw the wipe from the dispenser. The increased force can result in premature tearing of perforations between products to be dispensed, or may require designing perforations with increased resistance to tearing, thereby requiring additional force by the user to separate a product for use. Often, two hands are required to extract a treated or "wet wipe" (i.e. one hand to remove a wipe and the other to secure the container while the wipe is being removed from the container and tom from the next wipe). Unfortunately, however, sheet products such as wipes are often needed when only one hand is available (e.g. when cleaning an infant), which makes rolled perforated wipes dispensed from a container an undesirable combination due to the high dispensing forces which may lift the container.

Another common form of wipes that is not dispensed from a rigid container includes the individual prepackaged wet wipes often handed out at restaurants or on airplanes. These wet wipes are often folded and placed in individual moisture resistant pouches, then lotion and/or a cleansing agent is added, and the pouch is heat sealed. The consumer tears open the package to use the wipe, and then disposes of both the pouch and the wipe. Typically, this is also a two-handed operation, and there is considerable waste created in the form of the individual pouches, making this method of packaging and dispensing undesirable as well.

For generally dry sheets, a known manner of dispensing individual (i.e. pre-cut, interfolded, non-perforated) sheets is through a dispensing container. The dispensing container can be a box with a lid that is opened each time a sheet is needed, it can be a box with a lid and an aperture that individual sheets are pulled through, or it can be a combination of both a lid and an aperture. Generally dry sheets dispensed through a box with an aperture are typically rectangular and interfolded. Tissues and paper towels in restrooms are often dispensed in this manner.

As currently practiced, dispensing an interfolded sheet involves pulling one edge of an essentially rectangular sheet away from the dispenser. The interleaved portion of the two sheets serves to pull the adjacent portion of the next sheet due to the interfacial interaction of the two sheets at the overlap area. After the first sheet has been completely pulled through the aperture the two interfolded sheets begin to quickly separate. When the two sheets are completely separated, there should be a sufficient amount of the second sheet extending outside of the dispensing aperture to allow easy subsequent access to the second sheet. The portion of the second sheet remaining above the dispenser is commonly referred to as the "tail".

Dry sheets or tissues dispensed in this manner generally have a large overlap area consisting of an entire side of the rectangular sheet interfolded with an edge of the next sheet. However, as moisture is added to a sheet product, the large surface area of overlap often results in excessive interactive forces between the two sheets, causing a second sheet to be dispensed along with the first sheet due to the larger force required to separate the two sheets. Decreasing the surface area of overlap is difficult because this decreases the adhesive force, which controls the amount of the second sheet removed from the dispenser (to provide the "tail" for subsequent dispensing).

Currently, sheets that are moist, thick and non-woven, can not be dispensed by interleaving the sheets, as, due to the adhesion between sheets caused by the presence of high levels of moisture, the force required to separate two sheets is so great that multiple sheets are often dispensed with one pull (sometimes called "chaining"). Therefore, the sheets are typically folded individually and stacked one on top of the other and placed in a dispensing container. This dispensing method is less than optimal because there is no convenient tail to grab when a sheet is needed, generally resulting in a more difficult two-handed dispensing procedure.

U.S. Pat. No. 5,332,118 to Muckenfuhs (the '118 patent), discloses a series of designs for sheets that can be folded and used in an interleaved pop-up dispensing mechanism without the dispensing difficulties discussed above. The entire disclosure of the '118 patent is hereby incorporated herein by reference. An improved sheet design and method for forming sheet products, as described in the '118 patent, for use in pop-up dispensing applications is provided herein.

Methods for cutting continuous ribbons with variable edge geometries have been described in a variety of references. For example, a continuous web can be cut into continuous ribbons by pulling the web over a rotating drum and contacting the web with a rotating blade. The blade can be stationary, which creates a ribbon with straight edges parallel to the machine direction, or it can oscillate in a direction perpendicular to the machine direction to create edges that are at least partially non-parallel to the machine direction.

Another method of cutting irregular shapes on the edge of a continuous traveling web is to use a frame to hold multiple cutting devices, which may include water jets, lasers or blades. Multiple frames may also be used for the purpose of cutting shaped fabric pieces or for cutting shaped voids into a continuous fabric web. Another method of cutting a continuous woven web is with heated blades in order to seal the woven edges and to prevent the woven material from unraveling at the edges of the sheet.

Automated methods for folding a series of continuous ribbons into a continuous strata of overlapping sheets for use in a pop-up dispensing system are known to the art. Machines of this type have been used for folding continuous ribbons that have edges which are essentially straight and parallel to the longitudinal axis of the ribbons, e.g. tissues. Once the ribbons are interfolded, interleaved continuous stacks are produced, which are cut into blocks suitable for use in a pop-up dispenser.

Clearly, prior devices separately teach specific folding means, but continuing enhancement of sheet products for improved pop-up dispensing performance, as well as a better method for economically and efficiently producing such products, has been needed. There is a continuing need for improved sheet products and a method of manufacturing sheets that can be used effectively in a pop-up dispensing system. Further, there is a need for an improved process whereby ribbons can be, overlapped accurately and consistently, folded and cut into sheets for use in a pop-up dispensing system.

SUMMARY OF THE INVENTION

It is a primary object of this invention to manufacture an improved sheet for use in an interleaved pop-up dispensing system.

It is a further object of this invention that sheet products for pop-up dispensing applications can be more efficiently cut individually or continuously from a wider continuous web of material.

It is also an object of this invention to provide a no-waste alternative for cutting the improved sheets of this invention from a larger continuous web.

It is yet a further object of this invention to accomplish all of the above manufacturing improvements for both wet and dry sheets.

In accordance with one aspect of this invention, there is provided a method of cutting ribbons having a longitudinal axis between two opposing side edges, and having one or more knee-like protrusions formed on the side edges. The knee-like protrusions of one ribbon are aligned in a predetermined manner with the protrusions of an adjoining ribbon. Adjoining ribbons are then overlapped creating an area of greatest overlap between ribbons and an area of least overlap. The aligned and overlapped ribbons are then folded into continuous stacks which are cut to form blocks of interleaved individual sheets for use in a pop-up dispensing system.

In a more preferred embodiment there is provided a method of cutting ribbons having a longitudinal axis between two opposing side edges and on one of the side edges there is formed one or more knee-like protrusions. The opposing side edge of the ribbon is essentially parallel to the longitudinal axis of the ribbon. The knee-like protrusions of one ribbon are aligned with the essentially parallel side edge of an adjoining ribbon. Ribbons aligned in this manner are then overlapped creating an area of greatest overlap between the knee-like protrusions of one ribbon and the essentially parallel edge of the adjoining ribbon. Each area of greatest overlap is adjoined by an area of least overlap between adjoining ribbons. Multiple ribbons overlapped in this manner form a continuous strata of ribbons which is then folded into a continuous stack of interleaved ribbons. The continuous stack is cut in a direction essentially normal to the longitudinal axis of the ribbons forming blocks of interleaved individual sheets for use in a pop-up dispensing system.

Those processes discussed above can be accomplished in a continuous manufacturing process where the ribbons are cut from a wider web of fabric. If knee-like protrusions are cut into both edges of a ribbon, an unusable trim portion is created on the edge of the fabric web. However, in the preferred embodiment, where knee-like protrusions are cut into only one edge of the ribbon, waste can be eliminated from the manufacturing process.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 7D further shows where each ribbon will eventually be cut after they have been folded to produce the individual interleaved sheets.

DETAILED DESCRIPTION OF THE INVENTION

Figure 1:
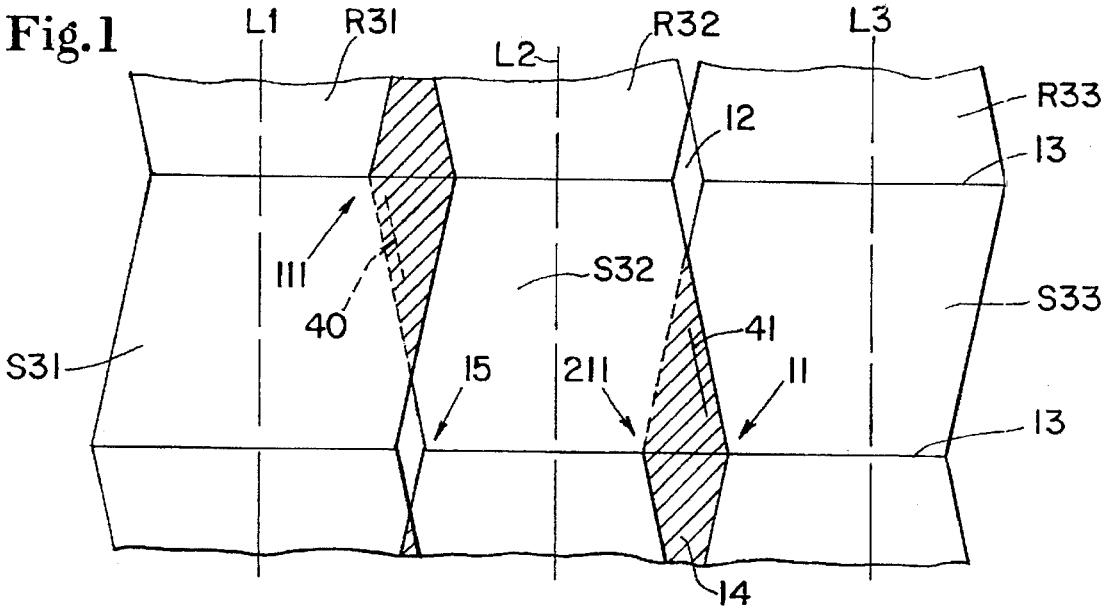
FIG. 1 shows a partial plan view of a plurality of overlapping ribbons made in accordance with the present invention.

Referring now to the drawings in detail, wherein like numerals indicate the same elements throughout the views, and wherein elements having the same final two digits (i.e., 12, 112, 212) indicate comparable elements of various preferred embodiments, FIG. 1 illustrates portions of three adjacent ribbons R31, R32, and R33 that have been cut, phased and overlapped in accordance with this invention. The area of greatest overlap 14 between two knee-like protrusions 11 and 211 and the adjoining area of least overlap 12 are created by first phasing the ribbons so that the knee-like protrusions 11 and 211 of adjoining ribbons R32 and R33 align. Ribbons (e.g. R32 and R33) are then overlapped creating the areas of greatest overlap 14 and least overlap 12. A knee-like protrusion (e.g. 11) on a ribbon (e.g. R32), is the portion of a side region (e.g. 40 and 41) of a ribbon (e.g. R32), that extends furthest from, and in a direction away from, the longitudinal axis (e.g. L2) of the ribbon. Overlapping multiple ribbons in this manner creates a continuous strata, as partially depicted as FIG. 1, which can then be folded and cut along lines 13 which in this preferred embodiment intersect the approximate midpoint of each knee-like protrusion (e.g. 11, 111, 211) on the side edge of each ribbon.

Figure 2:
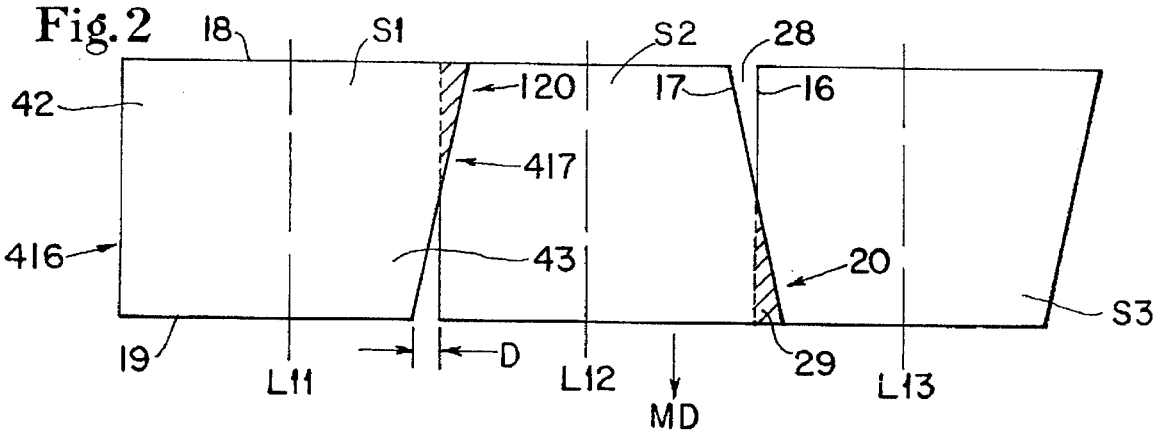
FIG. 2 is a plan view of three overlapping individual sheets made in accordance with the no-waste alternative of the present invention, where dimension D is the gap distance between the edges of two sheets at the area of least overlap.

FIG. 2 illustrates three individual sheets (S1, S2, and S3) made in accordance with a preferred embodiment of this invention. The cutting, phasing and overlapping of sheets manufactured in this manner are discussed in greater detail below. Overlapping sheets manufactured in this manner creates the necessary areas of greatest overlap 29 and areas of least overlap 28 between the side edge 16 that is parallel to the longitudinal axis L13 and the side edge 17 that contains the knee-like protrusion 20.

Sheet S1, FIG. 2, is illustrated as preferably including a longitudinal axis L11 which is substantially parallel to the machine direction MD of a forming apparatus as described herein during forming operations. Sheet S1 further comprises a pair of first and second side edges, 417 and 416 respectfully, spaced transversely from one another, and first and second side portions, 42 and 43 respectfully. Sheet S1 further comprises two essentially parallel end edges 18 and 19. A knee-like protrusion 120 is illustrated as extending transversely outwardly from axis L11 along the first side edge 417.

The second side edge 416 in this preferred configuration is essentially parallel to the longitudinal axis L11, however, a knee-like protrusion can be formed on both side edges as depicted in FIG. 1, 11 and 111. Further, it is preferred that where one or more knee-like protrusions are formed along the second side edge that at least one of such protrusions, e.g. FIG. 1, 11, are offset longitudinally from an oppositely deposed knee-like protrusion 111 to facilitate high speed processing, as will be explained below.

Figure 3:
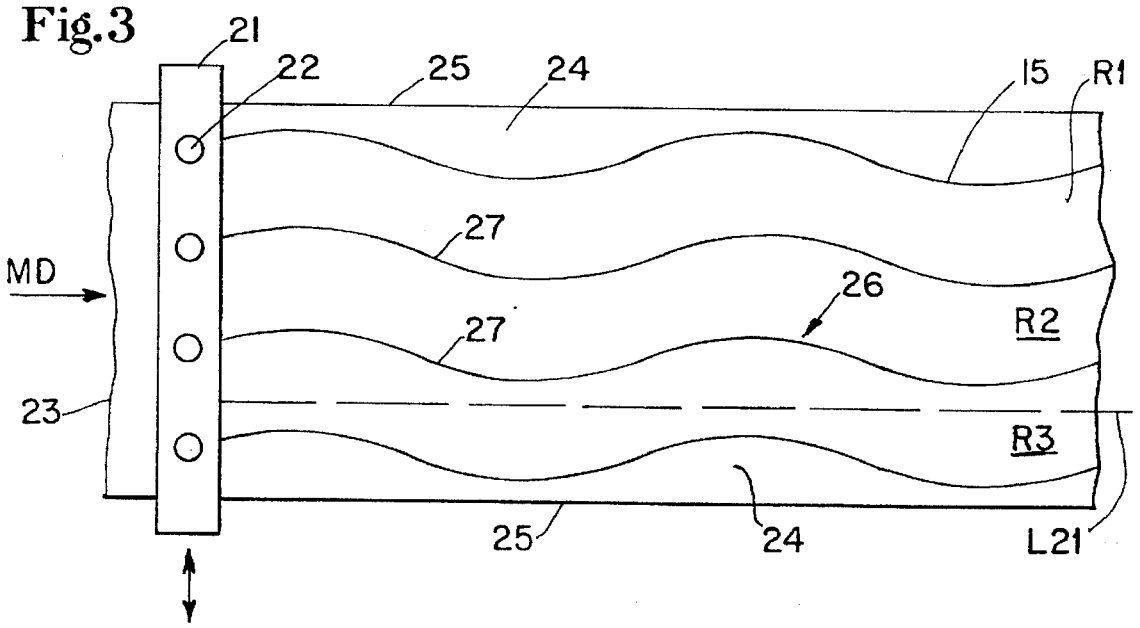
FIG. 3 is a partial schematic plan view of a travelling web passing through a cutting station comprising a plurality of cutting devices on a frame which can be oscillated in a direction essentially perpendicular to the machine direction of the web.

FIG. 3 depicts a traveling web 23 passing through a cutting station 21 which holds a plurality of cutting devices 22, which can be oscillated in a direction essentially perpendicular to the machine direction MD. The cutting devices 22 can be water jets, lasers, knives or any other suitable cutting devices. The cutting station 21 is preferably oscillated in a smooth, uninterrupted manner to produce curved, wave-like, opposing side edges 27 on the final ribbons R1, R2, and R3. A knee-like protrusion 26 is thereby formed on the edge of ribbon R3, which extends outwardly from the longitudinal axis L21 of ribbon R3. Also depicted at 26 is the cavity formed on the edge of the adjoining ribbon R2. A web 23 having side edges 25 which are essentially parallel to the machine direction MD, when cut as depicted as in FIG. 3, produces two trim pieces 24 which are essentially unusable waste as they do not form usable ribbons similar to the interior ribbons (e.g. R1, R2, and R3) cut from the web.

As can be appreciated, there are alternative methods for forming ribbons from a substantially continuous web of fabric. The web can be pulled over a rotating drum which is contacted with a knife or rotating blade (not shown), where the knife or rotating blade is oscillated in a direction essentially perpendicular to the machine direction of the traveling web to form the desired ribbon edge geometry. Likewise, rotating dies can be used (not shown), where the traveling web is pulled over the rotating die and the ribbons are slit with the desired edge geometry by the blades formed on the die.

Multiple ribbons can be formed from a single web of material. From a manufacturing efficiency perspective, it is generally advantageous to use a relatively wide based web of material from which a plurality of ribbons can be formed. It is generally preferable that at least four ribbons be formed from such a relatively wide based web of material.

Figure 4:
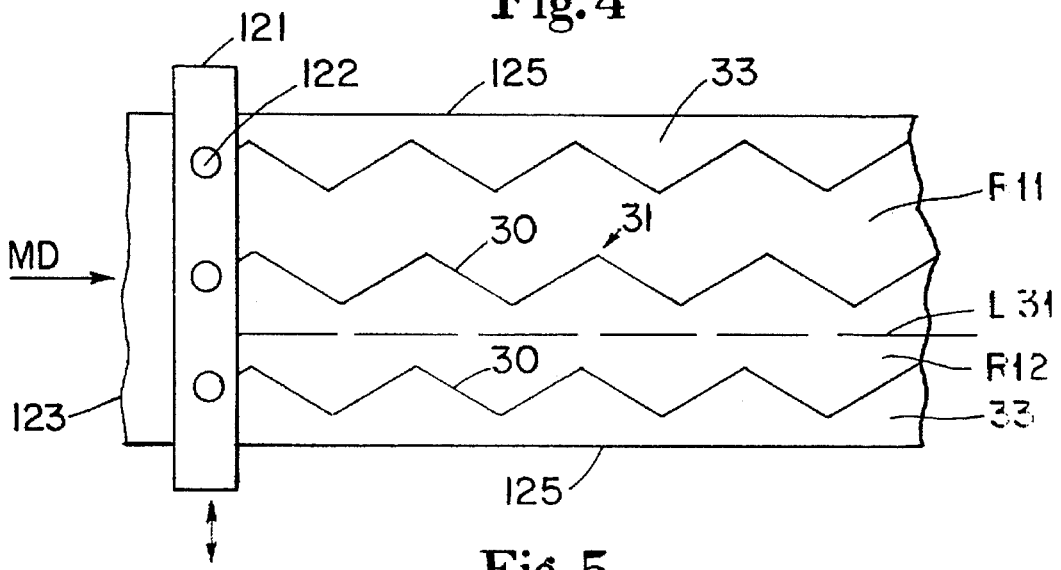
FIG. 4 is another partial schematic plan view of a relatively wide web of material being passed through a cutting station comprising a plurality of cutting devices.

FIG. 4 is similar to FIG. 3 in that a traveling web 123 is passed through a cutting station 121 holding a plurality of cutting devices 122, whereby a plurality of ribbons R11 and R12 are simultaneously cut. The difference between FIG. 4 and FIG. 3 is how the cutting station 121 is oscillated. If the direction of oscillation of the cutting station is changed in a substantially instantaneous manner, the knee-like protrusions (e.g. 31) will have more angular edges 30. An exemplary angular knee-like protrusion is depicted at 31 on ribbon R12, and there is a corresponding valley, also at 31, on the adjoining ribbon R11. The two edge waste portions 33 created by cutting ribbons from a web 123 having edges 125 essentially parallel to the machine direction MD, are also shown.

Figure 5:
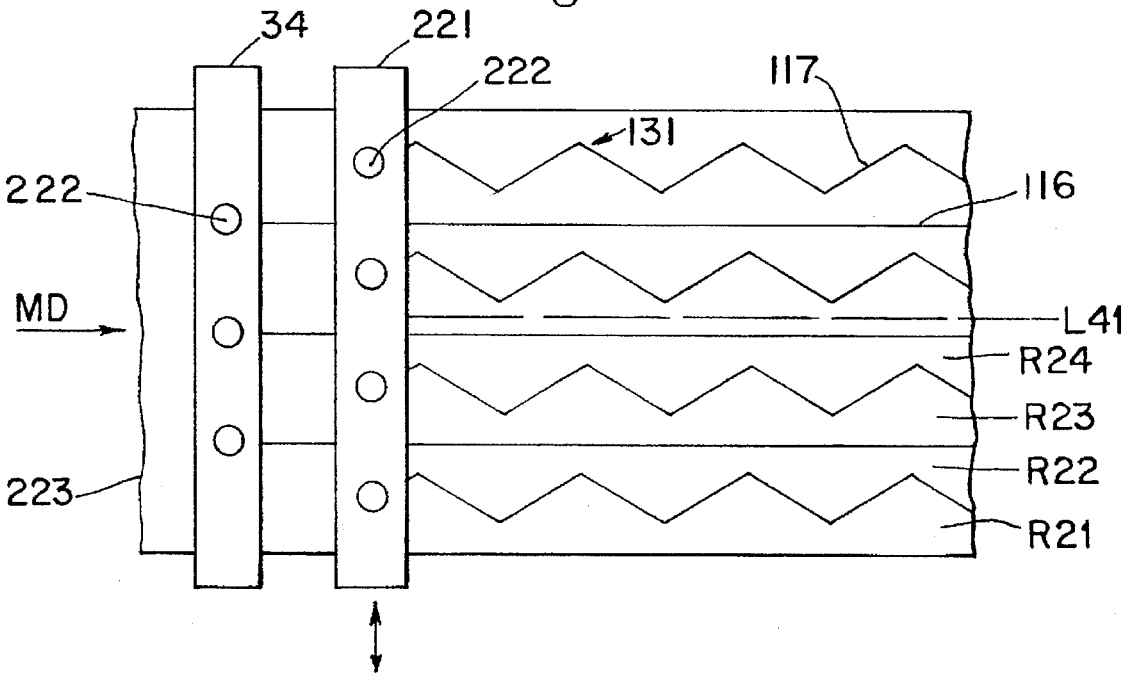
FIG. 5 is a partial schematic plan view of a travelling web passing through a cutting station comprising a plurality of cutting devices, at least one cutting station can be oscillated in a direction essentially perpendicular to the direction of travel of the web whereby ribbons can be produced with no edge waste.
Figure 6:
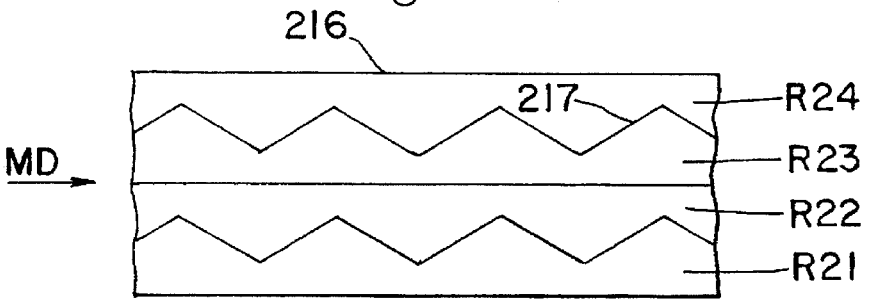
FIG. 6 is a partial plan view of four adjacent ribbons cut in a manner as depicted in FIG. 5.

A preferred arrangement for cutting ribbons with no-waste along the web edge is depicted in FIG. 5, wherein a combination of two or more cutting stations, one stationary 34 and one oscillated 221 are used. Both cutting stations contain a plurality of cutting devices 222, where the cutting devices on the oscillated cutting station move between cutting devices on the stationary cutting stations. The web 223 travels past both stations and is thereby cut into ribbons (e.g. R21, R22, R23, and R24) which have one edge 116 which is essentially parallel to the machine direction MD, and an opposing edge 117 which has knee-like protrusions (e.g. 131) formed thereon. FIG. 6 is a partial plan view of four adjacent ribbons (R21, R22, R23, and R24) cut in the manner depicted in FIG. 5.

Figure 7A:
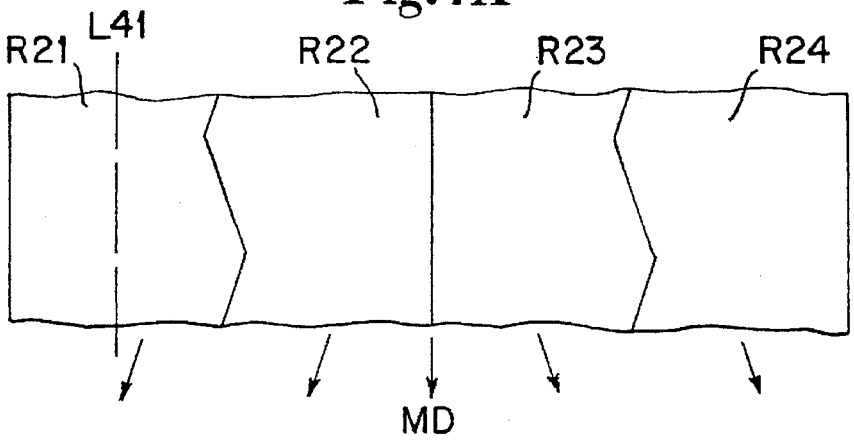
FIG. 7A. is also a partial plan view of four ribbons cut in a manner as depicted in FIG. 5.
Figure 7B:
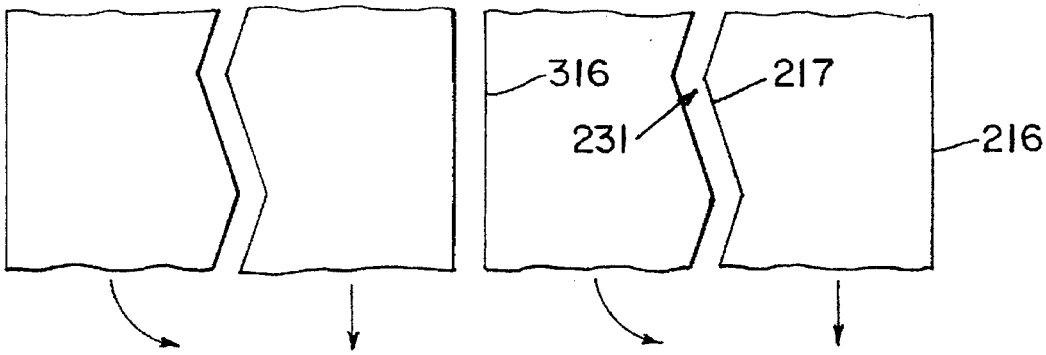
FIG. 7B. is a partial plan view of the four ribbons depicted in FIG. 7A after they are transversely separated.
Figure 7C:
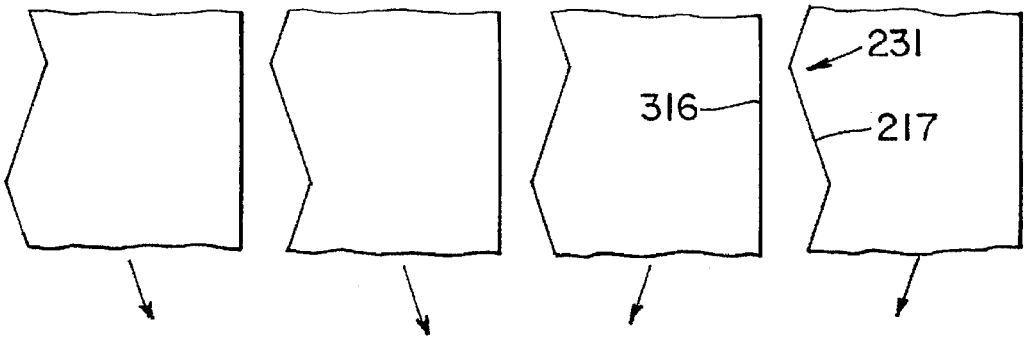
FIG. 7C. is a partial plan view of the four ribbons of FIG. 7B, after the ribbons have been phased by flipping over alternating ribbons to reverse the position of their respective side edges.

FIGS. 7A through 7D provide a schematic representation of the four ribbons (R21, R22, R23, and R24) depicted in FIG. 6, as cut by the process of FIG. 5, as the ribbons are separated (FIG. 7B), phased (FIG. 7C), overlapped and cut (FIG. 7D) to form individual sheets (S11, S12, S13, and S14) for use in a pop-up dispensing system. FIG. 7A is a schematic of the four ribbons (R21, R22, R23, and R24) after they are cut by the process depicted in FIG. 5. FIG. 7B shows the same four ribbons being separated in the process to more accurately depict the individual nature of the ribbons and to show the side edge 216 which is essentially parallel to the machine direction MD, and the opposing edge 217 which has the knee-like protrusions (e.g. 231) formed thereon. FIG. 7C shows the four ribbons (R21, R22, R23, and R24) after alternating ribbons (R21 and R23) have been flipped over so as to align each essentially parallel edge (e.g.

Figure 7D:
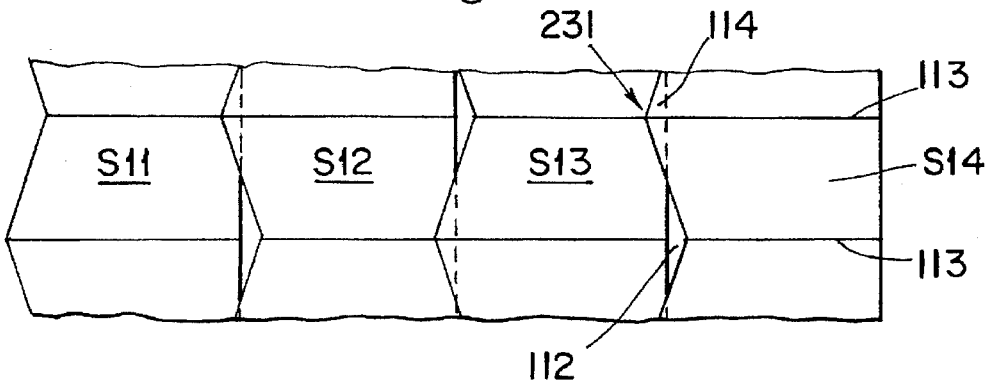
FIG. 7D illustrates schematically how the four ribbons depicted in drawings 7A, 7B, and 7C are then overlapped so as to create areas of greatest overlap and areas of least overlap between the ribbons.

316) of each adjacent ribbon (e.g. R23) with the knee-like protrusions (e.g. 231) of an adjoining ribbon (e.g. R24). FIG. 7D shows the four ribbons after they have been phased (by flipping over alternating ribbons R21 and R23), and overlapped to create the area of greatest overlap 114 and an adjoining area of least overlap 112. These overlapping ribbons are folded to form a stack of interleaved ribbons (not shown) and cut along the lines 113 which, in this preferred embodiment, intersects the approximate mid-point of each knee-like protrusion 231. Cutting through the approximate mid-point of the knee-like protrusions is preferred because two areas of overlap are created (one on either side of the cut line), thus, reducing by half the number of knee-like protrusions that must be formed on each ribbons edge.

Phasing of ribbons can also be accomplished in alternative manners to the method of flipping the ribbons as depicted in FIG. 7. For example, the knee-like protrusions 11 of the ribbons of FIG. 1, (R31, R32, and R33), which can be manufactured as depicted in the cutting process of FIG. 4, can be aligned by flipping alternating ribbons (e.g. R32). In the alternative, alternating ribbons (e.g. R32) can be pulled over individual phasing idlers which can be adjusted in position such that alternating ribbons travel different distances before they are overlapped so that the knee-like protrusions 11 and 211 on the edges of adjoining ribbons (e.g. R32 and R33) overlap. A cylindrical roller, or the like, can be used as an individual phasing idler. Multiple cylindrical rollers can also be used to flip a traveling ribbon by varying the angles of the cylindrical rollers so that the ribbon is gradually twisted 180 degrees about its longitudinal axis.

A critical design dimension which optimizes the dispensing parameters for the individual sheets is depicted in FIG. 2 as "D". D is the nominal distance from one sheet edge to the adjoining sheet edge at the point of least overlap. The distance D can be greater than, less than, or equal to zero to account for a gap between the corners of adjoining sheets, an area of overlap between the corners of the sheets, or when the corners of adjoining sheets touch but do not overlap, respectively. For hand wipes and the like, for example, a target distance for this gap might be from about 2 mm to approximately 12 mm at the point of least overlap, or more preferably between about 5 mm and 7 mm. The size and shape of the protruding area, and subsequently the size and shape of the area of overlap, can also be adjusted while maintaining a constant gap distance. The '118 Patent to Muckenfuhs, incorporated herein by reference, discusses the overlapping, interleaving and dispensing of sheets in detail. Although the sheet products, and method of manufacture of the present invention are not discussed in Muckenfuhs, the general principles of areas of greatest overlap and least overlap between sheets is applicable to the present invention.

Once a plurality of ribbons have been overlapped in side by side relationship, they must be folded into a stack of interleaved ribbons and then cut into blocks of individual interleaved sheets. Machines can be utilized for the automatic folding of a continuous strata of overlapped ribbons. Interleaving and folding machines are well known in the "tissue" art. As a practical matter, the process of overlapping and folding of continuous ribbons can be completed essentially simultaneously in a folding machine such as those currently used in the "tissue" industry. The overlapping and folding steps are discussed separately throughout this disclosure primarily for the purpose of clarity. Although z-folding is the preferred method for interleaving sheets of this invention, a variety of common folding processes can be used, including c- and u-folding.

As can be understood, the number of ribbons in a stack determines the number of sheets in a block. The desired number of sheets in the final block can be obtained by overlapping a corresponding number of ribbons (e.g. to produce an eighty count box of tissues, eighty ribbons are stacked and interfolded and each block cut therefrom will contain eighty tissues).

Another process common in the industry is the manufacturing of "clips" of product. A clip is a stack of sheets that is smaller in number than the desired final product. Clip folding and stacking machines common to the art produce stacks of four to ten ribbons which can be cut into clips of four to ten sheets. An appropriate number of clips are stacked one on top of the other and each clip is interleaved, or releasably attached to adjoining clips so that a block of a predetermined number of sheets is formed.

Cutting is preferably undertaken at the approximate mid-point of each knee-like protrusion, see FIG. 1, 11 and 111, in a direction essentially perpendicular to the longitudinal axis L1, L2, and L3 of the overlapped and folded ribbons R31, R32, R33. The cut lines 13, as depicted in FIG. 1, occur across the mid-point of each knee-like protrusion and again at points equidistant between each successive overlapping protrusions to form blocks of individual interleaved sheets. The ribbons depicted in FIG. 1 have knee-like protrusions 11, 111 formed on both side edges and when the ribbon is cut through the mid-point of a knee-like protrusion 11 the adjoining cavity 15 on the opposing side edge is also cut at its approximate mid-point. The individual sheets S31, S32, and S33 resulting from the cutting of ribbons as depicted in FIG. 1 and as manufactured in the process depicted in FIG. 4, will have knee-like protrusions on two alternating corners 11, 111 of the sheet S32. This cutting method is preferred because each knee-like protrusion that is formed by cutting the ribbon is cut into two knee-like protrusions, one on each adjoining sheet. Thus, the number of knee-like protrusions that must ultimately be formed is reduced by half. However, any cut line that produces an area of greatest overlap adjacent an area of least overlap along the interleaved edges between adjoining sheets is an acceptable cut line.

Once formed, the individual blocks of folded interleaved sheets are placed in dispensers where one sheet at a time can be dispensed, leaving a convenient tail for the next dispensing. Preferably, lotion (which may contain moisturizers, cleansing agents, water, etc.) is added to the block of sheets while it is being packaged. However, as can be appreciated, lotion can be added at any convenient point during the manufacturing process including on the web prior to any cutting operations.

As an example, after the block of individual interleaved sheets are placed in a dispenser, the tail of the first sheet is pulled by the consumer away from the dispenser, which in turn pulls the overlap section of the sheet being dispensed and the next sheet through the aperture of the dispenser. The physical interaction between the sheet being dispensed and the next sheet in the dispenser, allows the two sheets to bond together such that the sheet being dispensed pulls the tail of the next sheet toward and through the dispensing aperature. Preferrably, when the area of least overlap begins to emerge from the dispenser a separation front is created at the area of least overlap. As the interaction between the two sheets is decreased, the separation front continues through the interface between the two sheets. The separation front continues until the two sheets are separated leaving a convenient tail of the next sheet remaining above the container.

Having shown and described the preferred embodiments of the present invention, further adaptation of the improved sheet products and method of forming described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the structures and methods shown and described in the specification and drawings.

I claim:

1. An improved method of forming a strata of overlapping sheets suitable for use in a pop-up dispensing system, said method comprising the steps of:

forming a plurality of ribbons each having a longitudinal axis and opposed first and second side portions and first and second side edges spaced transversely from said longitudinal axis, wherein said first side edge has one or more knee-like protrusions, and said second side edge is either substantially parallel with said longitudinal axis or includes one or more knee-like protrusions extending outwardly from said longitudinal axis;

phasing adjacent ribbons in a direction parallel to their longitudinal axis such that a knee-like protrusion of a first side edge of one ribbon is aligned with either the substantially parallel second side edge or a corresponding knee-like protrusion of a second side edge of an adjacent ribbon;

overlapping at least a portion of said knee-like protrusion of said first side portion with said second side portion of adjacent phased ribbons to form a strata of overlapped ribbons, creating a series of areas of greatest overlap adjoining areas of least overlap;

folding said strata of overlapped ribbons to form a stack of folded interleaved ribbons; and cutting said stack of folded interleaved ribbons across said longitudinal axis to form blocks of individual interleaved sheets.

2. The method of claim 1, wherein said plurality of ribbons are all formed with second side edges which are substantially parallel to said longitudinal axis.

3. The method of claim 1, wherein said forming of the plurality of ribbons is undertaken in a substantially continuous process, wherein a relatively wide base web of material is passed through a cutting station to form said plurality of ribbons.

4. The method of claim 3, wherein said base web of material is moved in a predetermined machine direction, and wherein as such base web is passed through said cutting station, a plurality of ribbons are formed with their side edges being spaced in a direction transverse to said machine direction.

5. The method of claim 4, wherein said cutting station comprises at least one cutting device which can be moved in a direction transverse to said machine direction to selectively provide knee-like protrusions along a side edge of ribbons formed therein.

6. The method of claim 5, wherein said cutting station further comprises at least one cutting device which is maintained substantially stationary relative to said transverse direction as said base web is cut, thereby providing a side edge which is substantially parallel with the longitudinal axis of a ribbon.

7. The method of claim 1, wherein said phasing step comprises reversing the position of the opposing side edges of ribbons such that either the parallel side edge of one ribbon is adjacent to the side edge of an adjoining ribbon having knee-like protrusions formed therein or the knee-like protrusions on the side edge of one ribbon overlap the knee-like protrusions on the side edge of an adjacent ribbon.

8. The method of claim 7, further comprising the step of phasing adjacent ribbons such that a predetermined area of overlap will result from overlapping aligned side regions.

9. The method of claim 3, wherein said phasing step is facilitated by providing individual phasing idler rolls at predetermined spacings along said machine direction for individual ribbons.

10. The method of claim 1, wherein said cutting of said stack of folded interleaved ribbons is in a direction substantially normal to said longitudinal axis and is undertaken at the approximate mid-point of each overlapping protrusion and again at points equidistant between each successive overlapping protrusions to form blocks of individual interleaved sheets.

11. An improved method of forming a strata of overlapping sheets suitable for use in a pop-up dispensing system, said method comprising the steps of:

forming a plurality of ribbons each having a longitudinal axis and opposed first and second side portions and first and second side edges spaced transversely from said longitudinal axis, by passing a relatively wide base web of material through a cutting station, wherein said first side edge has one or more knee-like protrusions, and said second side edge is either substantially parallel with said longitudinal axis or includes one or more knee-like protrusions extending outwardly from said longitudinal axis in an opposite direction from said protrusion on said first side;

phasing adjacent ribbons in a direction parallel to their longitudinal axis such that a knee-like protrusion of a first side edge of one ribbon is aligned with either the substantially parallel second side edge or a corresponding knee-like protrusion of a second side edge of an adjacent ribbon;

overlapping at least a portion of said knee-like protrusion of said first side edge with said second side edge portion of adjacent phased ribbons to form a strata of overlapped ribbons, creating a series of areas of greatest overlap adjoining areas of least overlap areas;

folding said strata of overlapped ribbons to form a stack of folded interleaved ribbons; and cutting said stack of folded interleaved ribbons across said longitudinal axis to form blocks of individual interleaved sheets.

12. The method of claim 11, wherein said plurality of ribbons are all formed with second side edges which are substantially parallel to said longitudinal axis.

13. The method of claim 11, wherein said phasing step comprises reversing the position of the opposing side edges of one or more ribbons.

14. The method of claim 13, wherein said relatively wide base web of material is cut into a plurality of ribbons by passing the base web through a cutting station in a predetermined machine direction, and wherein at least one of the resulting ribbons is rotated along an axis parallel to said machine direction to effectively reverse the location of the opposing side edges of said at least one ribbon.

15. The method of claim 14, further comprising the step of selectively phasing adjacent ribbons such that predetermined areas of overlap will result from overlapping phased side regions.

16. The method of claim 11, wherein said cutting of said stack of folded interleaved ribbons is in a direction substantially normal to said longitudinal axis and is undertaken at the approximate mid-point of each overlapping protrusion and again at points equidistant between each successive overlapping protrusions to form blocks of individual interleaved sheets.

17. An improved interleaved sheet arrangement for use in a pop-up dispensing system, said arrangement comprising a block of partially overlapping individual sheet products created by:

forming a plurality of ribbons each having a longitudinal axis and opposed first and second side portions and first and second side edges spaced transversely from said longitudinal axis, wherein said first side edge has one or more knee-like protrusions, and said second side edge is either substantially parallel with said longitudinal axis or includes one or more knee-like protrusions extending outwardly from said longitudinal axis in an opposite direction from said knee-like protrusion on said first side;

phasing adjacent ribbons in a direction parallel to their longitudinal axis such that a knee-like protrusion of a first side edge of one ribbon is aligned with either the substantially parallel second side edge or a corresponding knee-like protrusion of a second side edge of an adjacent ribbon;

overlapping at least a portion of said knee-like protrusion of said first side edge with said second side edge portion of adjacent phased ribbons to form a strata of overlapped ribbons, creating a series of areas of greatest overlap adjoining areas of least overlap;

folding said strata of overlapped ribbons to form a stack of folded interleaved ribbons; and cutting said stack of folded interleaved ribbons across said longitudinal axis to form blocks of individual interleaved sheets.

18. The improved interleaved sheet arrangement of claim 17, wherein said plurality of ribbons are all formed with second side edges which are substantially parallel to said longitudinal axis.

19. The improved interleaved sheet arrangement of claim 17, wherein a relatively wide base web of material is cut into said plurality of ribbons by passing the base web through a cutting station in a predetermined machine direction and wherein at least one of the resulting ribbons is rotated along an axis parallel to said machine direction to effectively reverse the location of the opposing side edges of said at least one ribbon.

20. The improved interleaved sheet arrangement of claim 19, further comprising the step of selectively phasing adjacent ribbon such that predetermined areas of overlap will result from overlapping phased side regions.

* * * * *